US005485165A

United States Patent [19]

Foard

[11] Patent Number: 5,485,165

[45] Date of Patent: Jan. 16, 1996

[54] BROADBAND HIGH EFFICIENCY FULL WAVE OPEN COAXIAL STUB LOOP ANTENNA

[75] Inventor: Richard D. Foard, Culpeper, Va.

[73] Assignee: The United States of America as represented by the Secretary of the Army, Washington, D.C.

[21] Appl. No.: 290,273

[22] Filed: Aug. 15, 1994

[51] Int. Cl.[6] ..... H01Q 11/12

[52] U.S. Cl. ..... 343/741; 343/743; 343/842

[58] Field of Search ..... 343/741, 743, 343/742, 744, 745, 842, 866, 870, 815, 818, 819, 833, 834; 333/26

[56] References Cited

U.S. PATENT DOCUMENTS

| | | | |
|---|---|---|---|
| 2,423,083 | 7/1947 | Daubaras | 343/842 |
| 2,495,747 | 1/1950 | Lundburg | 343/741 |
| 2,615,134 | 10/1952 | Carter | 343/742 |
| 3,902,177 | 8/1975 | Mori et al. | 343/842 |
| 4,083,006 | 4/1978 | Yakoshima | 343/842 |
| 4,983,985 | 1/1991 | Beatty | 343/741 |
| 5,363,113 | 11/1994 | Mametsa et al. | 343/744 |

OTHER PUBLICATIONS

Investigation of Parasitic Loop Counterpoise Antenna, Sengupta et al, IEE Transactions on Antenna and Propagation, vol. AP–17, No. 2, Mar. 1969 pp. 180–191.

*Primary Examiner*—Donald T. Hajec
*Assistant Examiner*—Tan Ho
*Attorney, Agent, or Firm*—Anthony T. Lane

[57] ABSTRACT

A broadband, high-efficiency loop radiator is characterized by a coaxial loop one wavelength in circumference with a continuous center conductor fed through a coaxial T feed and a discontinuity of the outer shield next to the feed point of 50 ohms input impedance. Radiation occurs as a result of this transmission line discontinuity resulting in a reflected wave back down the shield. The one wavelength dimension of the loop generates two in phase electric dipoles spaced one diameter apart resulting in a bidirectional radiation pattern of 3 dBil and a 30% operational bandwidth due to the frequency compensation of the open stub. The open stub loop antenna acts as a low loss parallel tuned circuit appearing across a generator and the series impedance of the loop antenna resulting in increased bandwidth.

7 Claims, 8 Drawing Sheets

BROADBAND HIGH EFFICIENCY FULL WAVE OPEN COAXIAL STUB LOOP ANTENNA

BACKGROUND OF THE INVENTION

With the advent of tuned loop antennas as a convenient antenna structure for reduced operational space requirements, there is a need for a broadband loop antenna which does not require tuning and yields near 100% efficiency. With conventional tuned loop structures, one to three dB of antenna gain may be lost due to inherent losses of the LC networks operating at high current levels as a result of high Q. This results in narrow operational bandwidths.

The present invention relates to single wire full wavelength loop antennas which are usually fed at a high impedance and which exhibit a narrow bandwidth. A full wave open stub coaxial loop provides maximum efficiency and maximum bandwidth at a convenient inherent 50 ohm feed impedance. The electrical length of the coaxial loop is greater than 1.4 wavelengths.

BRIEF DESCRIPTION OF THE PRIOR ART

Prior loop antennas yield gains of −4 dBil (λ/4 loop over a ground plane) at operating Q's of near 300. Efficient full wave wire loop antennas without frequency compensation yield Q's of 20 or greater.

The present invention was developed in order to provide the same high efficiency of prior loop antennas but with Q's of 3–4 (25–30% bandwidth). This compares favorably with the prior designs which have only about a 5% operational bandwidth.

SUMMARY OF THE INVENTION

Accordingly, it is a primary object of the invention to provide a broadband, high efficiency antenna radiator adapted for connection with an unbalanced feed line and source. The antenna comprises a section of coaxial cable having a length of one wavelength. The cable has a center conductor arranged in a continuous loop and an outer being arranged in a shorter loop to define an open section. A T-shaped connector connects the ends of the cable center conductor with the center conductor of the feed line and a bridging connector connects one end of the coaxial shield with the shield of the feed line. The radiator is thus configured as a coaxial open stub loop which provides maximum efficiency and bandwidth. The low Q or wide bandwidth of operation is due to the equivalent parallel tuned circuit achieved by use of the one wavelength open stub which comprises the loop itself.

According to another object of the invention, the loop configuration comprises a Yagi configuration for unidirectional operation with greater gain. Two loop and three loop Yagi configurations may be provided yielding high gain and extended operational bandwidths.

According to yet another object of the invention, the single loop may be narrowed physically for a wideband half-wave coaxial stub folded dipole having maximum gain and approximately 25% bandwidth.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1A:
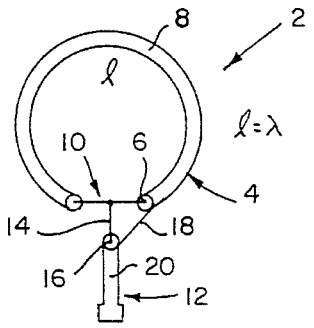
FIG. 1*a* is a plan view of the open stub full wave coaxial loop antenna according to the invention.

The full wave open stub coaxial loop antenna 2 is shown in detail in FIG. 1*a*. It comprises a section of coaxial cable 4, such as 50 ohm coaxial cable, having a length 1 of one wavelength λ. The cable includes a center conductor 6 arranged in a continuous loop and an outer shield 8 arranged in a shorter loop to define an open section or stub 10.

The loop antenna 2 is connected with an unbalanced feed line 12 and source (not shown). More particularly, a T-shaped connector 14 connects the center conductor 6 of the loop with a center conductor 16 of the feed line and a bridging connector 18 connects the shield 8 of the loop with the shield 20 of the feed line. Due to the geometry of the antenna being in the form of a loop, the phase and voltage at the end of the center conductor 6 are the same as that of the feed line center conductor 16.

Figure 1B:
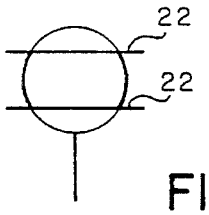
FIG. 1*b* is a schematic representation of the dipole equivalent for the antenna of FIG. 1*a;*

As will be developed in greater detail below, current flowing in the shield of the loop antenna generates two electric dipoles 22 shown in FIG. 1*b*.

Figure 2A:
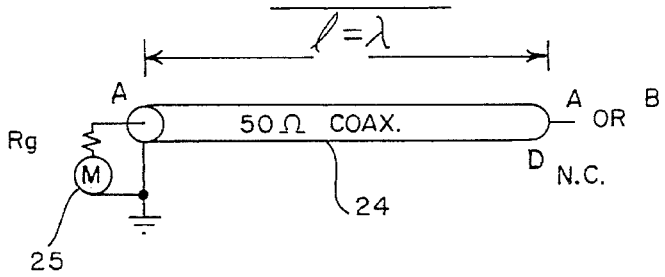
FIGS. 2*a* and 2*b* are diagrammatic and schematic representations, respectively, of the circuit equivalent for the antenna of FIG. 1*a;*
Figure 2B:
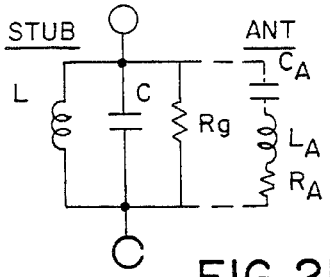

The principle of the design of the full wave open stub coaxial loop antenna is that of an unterminated, unbalanced transmission line 24 which is near one and a half wavelengths long and provides an additional equivalent parallel tuned circuit in parallel with the series tuned circuit of the loop with the generator 25 feeding the loop as shown in FIG. 2*a*. The circuit equivalent is shown in FIG. 2*b*.

The open stub coaxial loop antenna operates at a lower Q or in a wider bandwidth due to the equivalent parallel tuned circuit accomplished by use of the one wavelength open stub which is actually the loop itself. The parallel tuned circuit appears across the equivalent series tuned circuit of the loop with the generator in parallel.

Figure 3A:
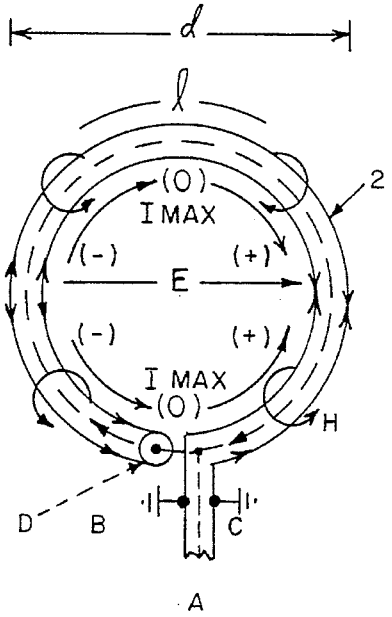
FIG. 3*a* is a plan view of the current flow through the antenna of FIG. 1*a* and FIG. 3*b* is a diagrammatic equivalent of the antenna of FIG. 3*a;*
Figure 3B:
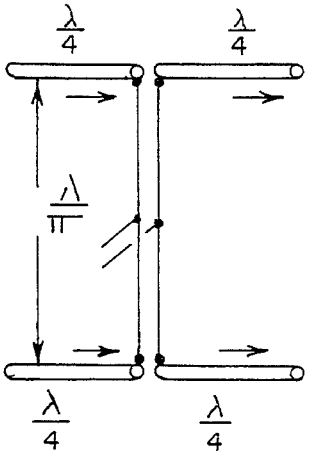

The current flow through the open stub coaxial loop antenna 2 is shown in FIG. 3*a* with the diagrammatic equivalent being shown in FIG. 3*b*. The current flow in the shield of the loop generates two electric dipoles, one centered at the feed point and the other λ/4 or one diameter away across from the feedpoint of the loop antenna.

Radiation occurs from the reflected standing waves from the unterminated end of the coaxial cable along the unterminated shield of the cable. The velocity factor of the coaxial cable does not slow the radiated wave since that radiation occurs on the outside of the shield as shown in FIG. 3*a*. This is verified by the physical length versus the electrical length of the coaxial cable determining the center of the operational frequency of the coaxial open stub loop antenna. No balun or impedance transformer is required.

Figure 4A:
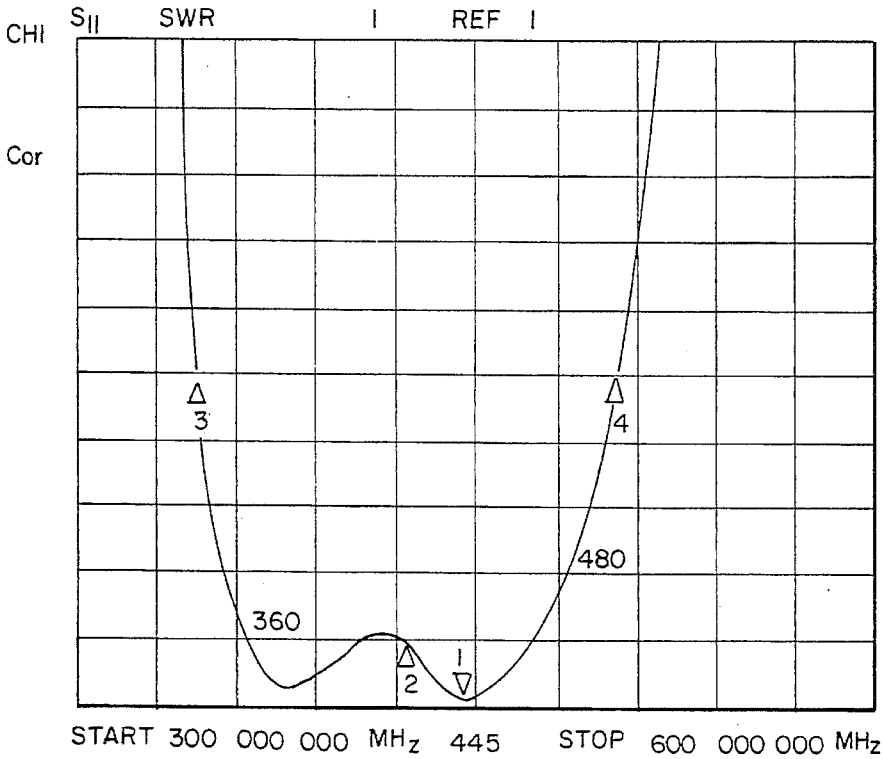
FIGS. 4*a* and 4*b* are graphical representations of the VSWR and impedance, respectively, of the loop antenna of FIG. 1*a* with a ground plane reflector.
Figure 4B:
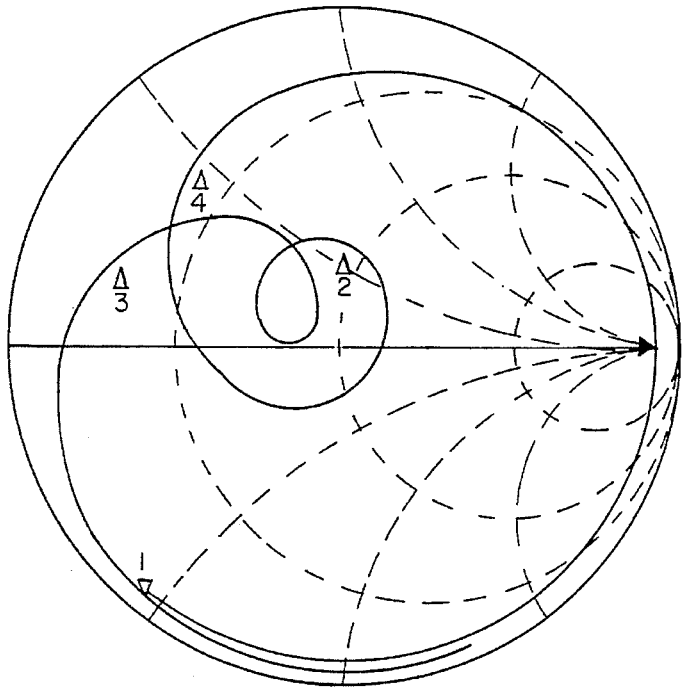
Figure 4C:
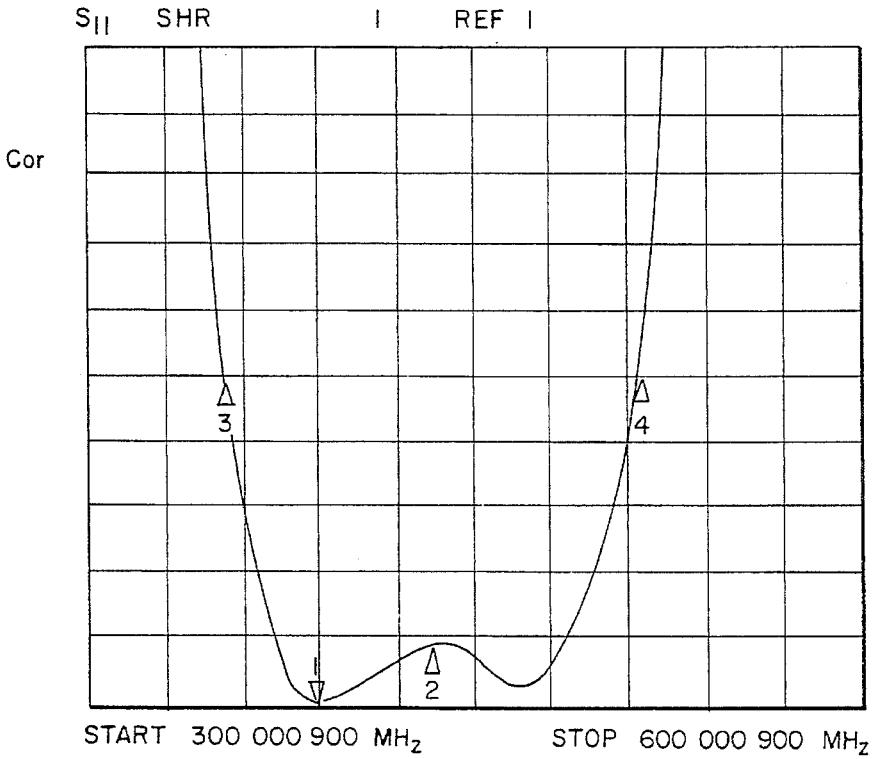
FIGS. 4*c* and 4*d* are graphical representations of the VSWR and impedance, respectively, of the loop antenna of FIG. 1*b* without a ground plane reflector.
Figure 4D:
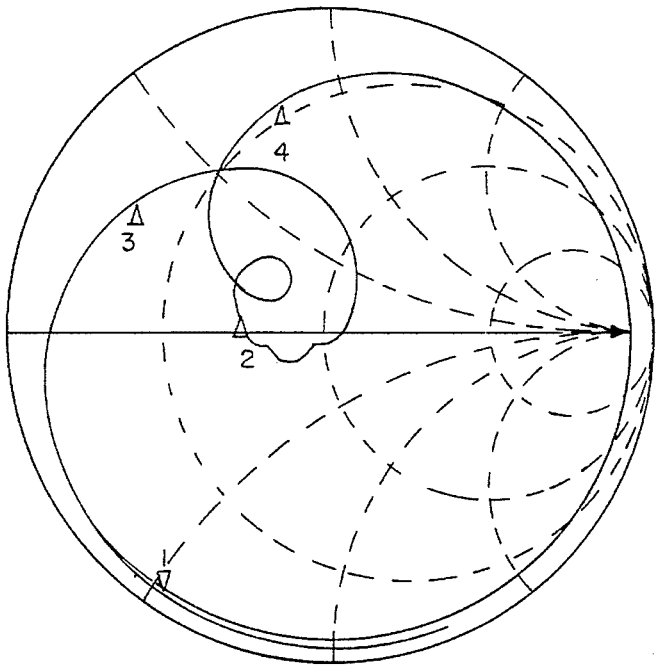

The loop antenna according to the invention can be used with or without a ground plane reflector. FIGS. 4*a* and 4*b* illustrate the VSWR and impedance of the antenna with a ground plane reflector, while FIGS. 4*c* and 4*d* illustrate the VSWR and impedance of the antenna without a ground plane reflector.

Figure 5:
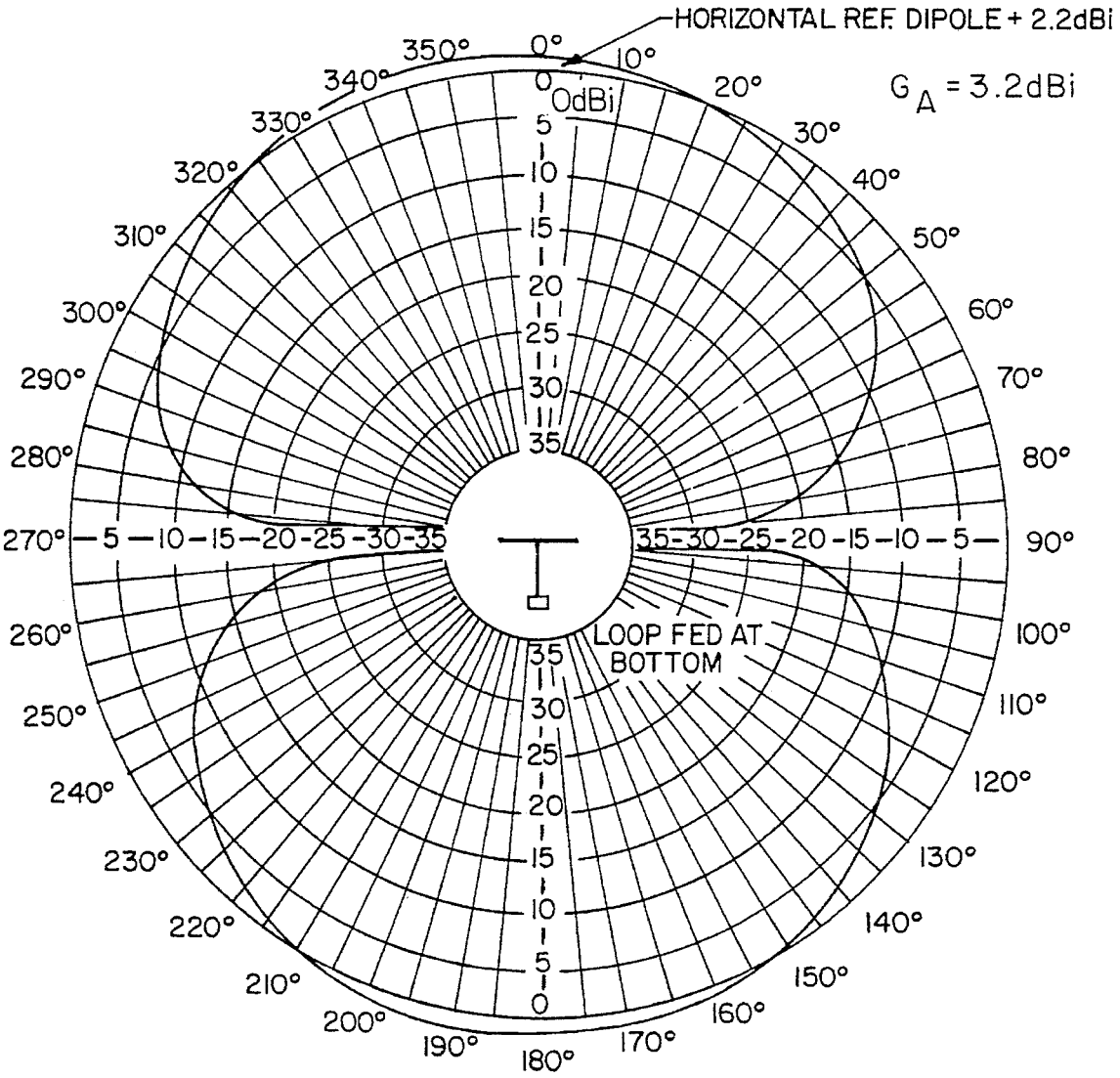
FIG. 5 is a graphical representation of the E-plane 3.2 dBi radiation pattern of the full wave loop antenna according to the invention.

In FIG. 5 is shown the radiation pattern generated by the two dipoles of the antenna. The dipoles are in phase λ/ apart. The radiation pattern has 3.2 dBil gain at bandwidths of near 30%. The antenna configuration according to the invention results in a structure that is not easily detuned by a high dielectric loading environment.

Figure 6:
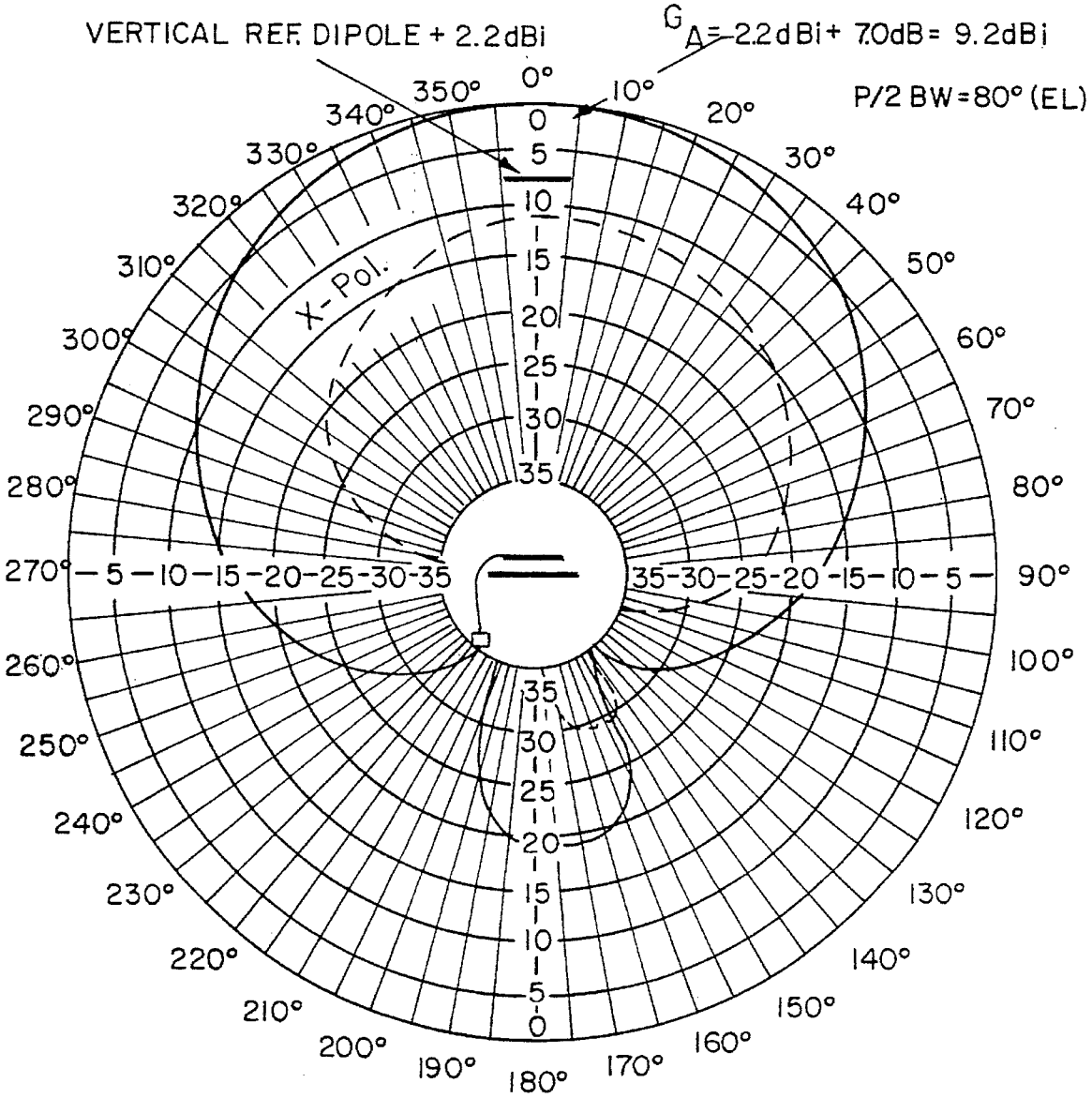
FIG. 6 is a graphical representation of the E-plane radiation pattern of the full wave loop antenna according to the invention arranged one quarter wavelength above a ground plane.

Referring now to FIG. 6, there is shown in the center a broadband 50 ohm stub coaxial loop 2 placed over a 1λ by 1λ ground plane metal plate 26 at a height of 0.2λ. The E-plane radiation pattern is also shown. The positioning of the antenna relative to the ground plane metal plate yields an additional 6 dBi gain for a total gain of 9.2 dBil with front to back pattern ratios of 20 dB and cross polarization values of −10 to −15 dB. The impedance and operational bandwidth of the loop radiator vary less than 10% with the additional loading of the ground plane as compared to those shown in FIGS. 4*b* and 4*d*.

Loop arrays of up to four loops fed in phase and spaced 0.8λ apart (center to center) at a height of 0.2λ above a ground plane yield 15.2 dBil of forward gain, pattern front to back ratios of near 20 dB, with E and H half power beamwidth of 32°.

Figure 9:
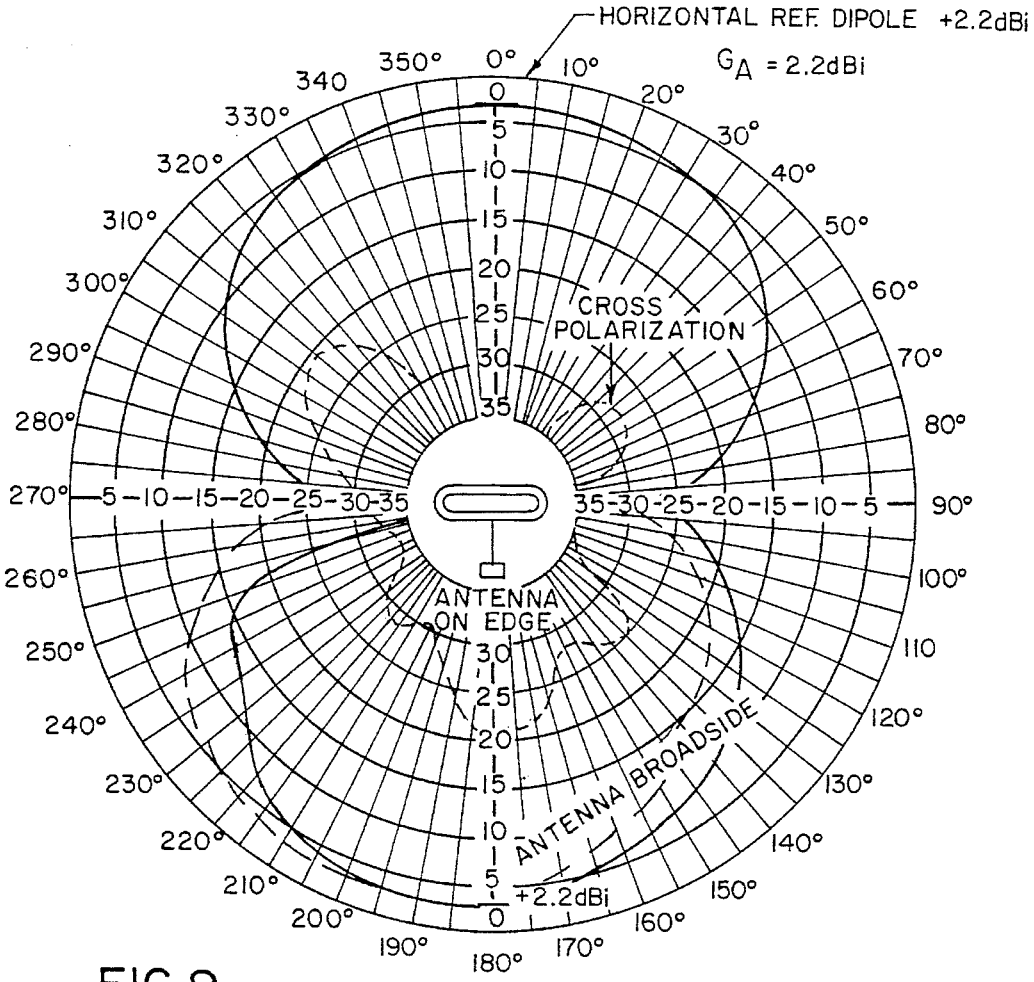
FIG. 9 is a graphical representation of the E-plane radiation pattern of a folded dipole coaxial loop antenna.
Figure 7:
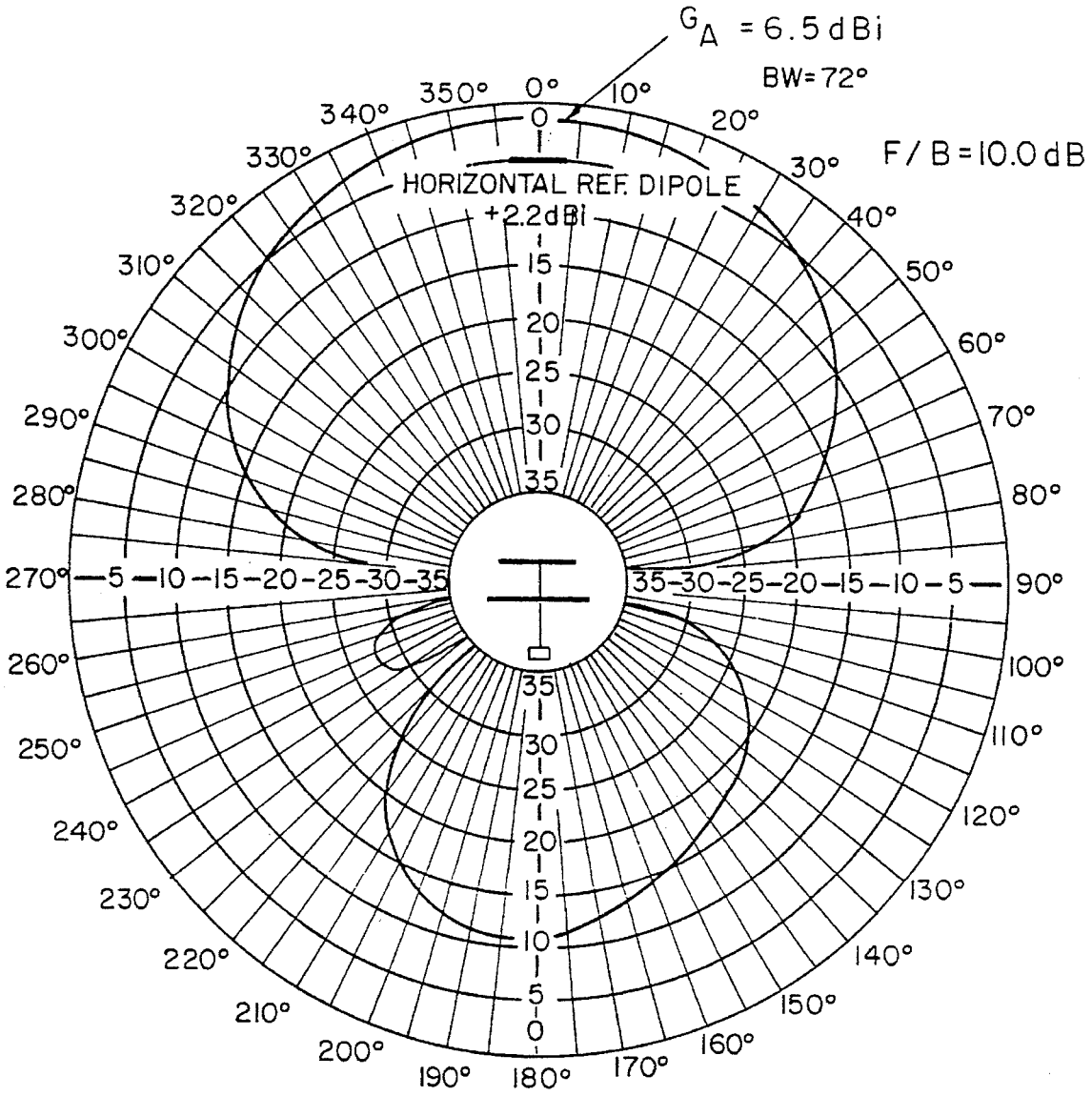
FIG. 7 is a graphical representation of the E-plane radiation pattern of a two loop coaxial Yagi configuration with the longer reflector loop feed shorted and spaced at 0.2λ.
Figure 8:
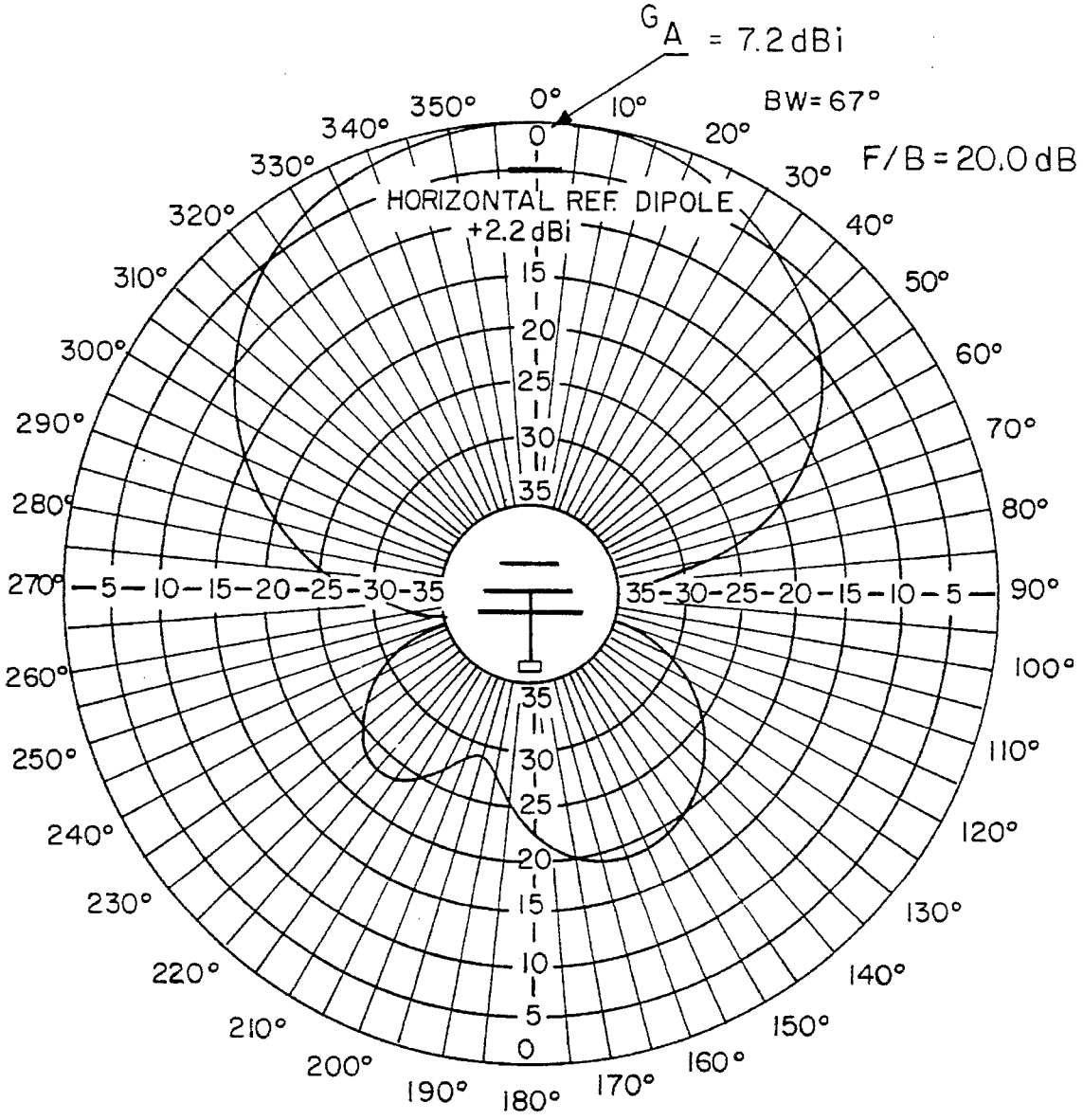
FIG. 8 is a graphical representation of the E-plane radiation pattern of a three loop Yagi configuration with the loops spaced at 0.2λ.

Other embodiments of the loop antenna and the E-plane radiation patterns therefor are shown in FIGS. 7–9. More particularly, in FIG. 7 there is shown a full-wave open stub coaxial loop in the form of a two loop Yagi antenna 28 and in FIG. 8 is shown a coaxial loop in the form of a three loop Yagi 30. The two loop Yagi yields a 6.5 dBil forward gain and the three loop Yagi yields a 7.2 dBil forward gain. Front to back pattern ratios of 10–20 dB are achieved. In FIG. 9 there is shown a coaxial loop in the form of a folded dipole 32 and its associated E-plane radiation pattern. The folded dipole comprises a single loop narrowed physically to define a wideband half-wave coaxial stub folded dipole with maximum gain and 25% bandwidth.

Figure 10:
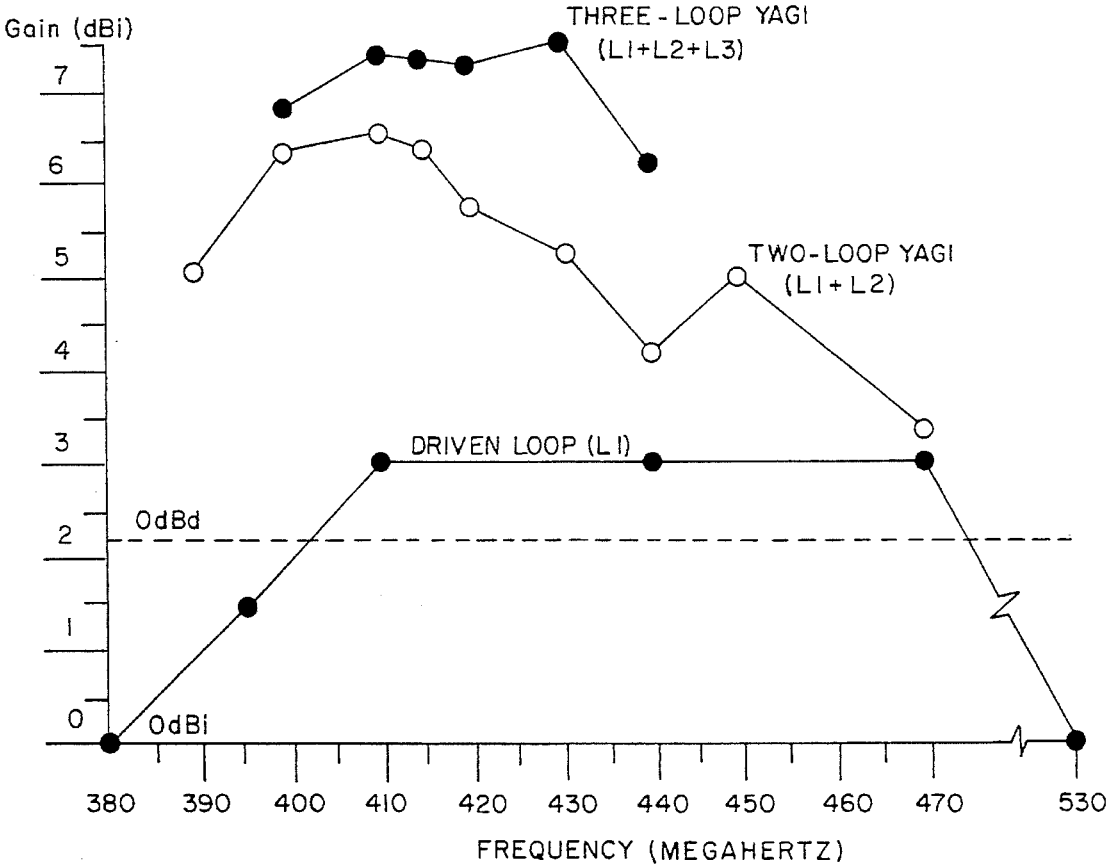
FIG. 10 is a graph showing the gain and bandwidth for the open stub full wave coaxial loop antenna, and the two loop Yagi, and three loop Yagi antennas.

In FIG. 10 there is shown a comparison of the gain achieved by the open stub coaxial loop (FIG. 5), the two loop Yagi (FIG. 7), and the three loop Yagi (FIG. 8). As shown therein, the two and three loop Yagi arrays yield higher gains. The reflector and director elements of the Yagi arrays are typically 12% longer and shorter, respectively, and the arrays yield 20 to 30% operational bandwidths. The driven element maintains its 50 ohm match without adjustment with either or both a reflector or director added.

With the full wave open coaxial stub loop antenna according to the invention, there is provided a large gain bandwidth device due to the frequency compensation of the open stub and the elimination of the usual balun.

What is claimed is:

1. A broadband, high efficiency antenna radiator adapted for connection with an unbalanced feed line and source, comprising (a) a section of coaxial cable having a length of one wavelength and including a center conductor and an outer shield, said center conductor being arranged in a continuous loop and said outer shield being arranged in a shorter loop to define an open stub; and (b) means for connecting said cable with the feed line, including a T-shaped connector arranged in said open stub for connecting the ends of said cable center conductor with a center conductor of the feed line and a bridging connector for connecting one end of said coaxial shield with a shield of the feed line, thereby to define a coaxial open stub loop which provides maximum efficiency and bandwidth.

2. An antenna radiator as defined in claim 1, wherein said coaxial open stub loop generates two equivalent in phase dipoles, one centered at said connecting means and the other spaced diametrically opposed from said connecting means.

3. An antenna radiator as defined in claim 1, wherein said coaxial cable is configured as a two-element coaxial loop Yagi.

4. An antenna radiator as defined in claim 3, and further comprising a coaxial loop director.

5. An antenna radiator as defined in claim 1, wherein said coaxial cable is configured as a three-element coaxial loop Yagi.

6. An antenna radiator as defined in claim 5, and further comprising a coaxial loop director.

7. An antenna radiator as defined in claim 1, and further comprising a ground plane reflector arranged parallel to said coaxial open stub loop and spaced from said loop by a distance of 0.2 wavelength.

* * * * *